United States Patent [19]

Vitta

[11] Patent Number: 4,718,628

[45] Date of Patent: Jan. 12, 1988

[54] ADJUSTABLE SHORE

[76] Inventor: Michael Vitta, 7 Elmwood Ave., Salem, N.H. 03079

[21] Appl. No.: 842,673

[22] Filed: Mar. 21, 1986

[51] Int. Cl.[4] ..... E04G 25/02

[52] U.S. Cl. ..... 248/354.3; 248/541; 52/632; 52/126.1

[58] Field of Search ..... 248/354.3, 354.5, 357, 248/541, 354.6; 52/632, 126.1

[56] References Cited

U.S. PATENT DOCUMENTS

| | | | |
|---|---|---|---|
| 1,740,876 | 12/1929 | Sauer | 248/357 |
| 2,714,498 | 8/1955 | Wuthrich | 248/354.3 |
| 2,925,981 | 2/1960 | Wilson et al. | 248/354.4 X |
| 2,945,662 | 7/1960 | Jennings | 248/354.3 X |
| 3,324,613 | 6/1967 | Duboff | 52/632 X |
| 4,449,876 | 5/1984 | Glanton | 52/632 X |

FOREIGN PATENT DOCUMENTS

| | | | |
|---|---|---|---|
| 1355867 | 2/1964 | France | 248/354.3 |

*Primary Examiner*—Ramon S. Britts
*Assistant Examiner*—Karen J. Chotkowski
*Attorney, Agent, or Firm*—Edward A. Gordon

[57] ABSTRACT

An adjustable shore frame is disclosed which has a first sleeve member adapted to slidably receive a major length adjusting vertical support member and a second sleeve member adjacent to the first sleeve member and adapted to slidably receive a minor length adjusting vertical support member. First adjusting members are adapted, in association with the first sleeve member, to longitudinally releasably engage a major length adjusting member relative to the first sleeve member to provide major or rough adjustment of the overall length of the shore. Second adjusting members are adapted, in association with the second sleeve member, to provide for continuous instantaneous extension or retraction of the minor length adjusting vertical support member longitudinally relative to the second sleeve member to provide for minor or fine adjustment of the overall length of the shore.

16 Claims, 5 Drawing Figures

ADJUSTABLE SHORE

FIELD OF THE INVENTION

This invention relates to shoring apparatus and more particularly to an adjustable shore frame structure providing major and minor length adjustments to provide temporary support to various structures.

BACKGROUND OF THE INVENTION

In prior art patents there are disclosed various shoring devices adapted to temporarily support various structures.

In U.S. Pat. No. 1,193,233 there is disclosed an adjustable shore in which two uprights are slidably secured to each other by a pair of U-shaped metal bands with one upright having notches and the other having a bolt for engaging the notches to attain the height required. In U.S. Pat. No. 1,570,226 there is disclosed an adjustable shore which comprises a pair of posts (1) and (2), and a frame structure adjustably supported on one post (1) by wedges and which in turn support the other post (2) by a pin which is adjustable to various positions along the frame for obtaining a rough adjustment of the shore prior to the final setting which is obtained by the expansion and contraction of the wedges. In U.S. Pat. No. 1,757,312 there is disclosed an adjustable shore which comprises a post, a guide in which the post is fitted for linear adjustment, a stirrup holding the post and wedges associated with the stirrup and guide for linear adjustment of the post. In U.S. Pat. No. 2,925,981 there is disclosed a two piece adjustable shoring apparatus which comprises a cage-like structure in which a post is inserted and moved lengthwise by length adjusting members.

While the above referred to shoring apparatus have proved to be successful in achieving the objects for which they were intended, it has become desirable to provide an improved adjustable shore frame having a simple structure and a minimum of components which provides an improved shore structure for quickly obtaining major or rough length adjustment and thereafter quickly obtaining minor or fine adjustment to the overall desired length without the need of the complicated, expensive, and time consuming shoring devices of the prior art.

Accordingly, a desirable object of the present invention is to provide an improved adjustable shore frame which accommodates varying heights and which is especially adapted for use as a temporary shore.

Another desirable object of the present invention is to provide an adjustable shore frame structure which provides improved means for quickly making major length adjustments and subsequently making relatively minor length adjustments to vary the overall or effective length as desired.

A still further desirable object of the present invention is to provide an adjustable shore frame which provides for instantaneous continuous fine adjustment of the overall length of the shore as desired.

Another desirable object of the invention is to provide an adjustable shore having a simple and inexpensive form of construction.

Another desirable object of the present invention is to provide an adjustable shore frame which can utilize lumber of standard thickness for major and minor length adjusting members.

A still further desirable object of the present invention is to provide an adjustable shore which can be quickly and easily installed, which is easy and certain in operation, and does not require skilled labor.

SUMMARY OF THE INVENTION

The present invention reduces the difficulties and disadvantages of the prior art by providing an improved and novel adjustable shore frame which quickly accomodates varying heights and which is especially adapted for use as a temporary shore structure. More particularly, in accordance with the present invention, the adjustable shore frame comprises a first sleeve member adapted to slidably receive a major length adjusting vertical support member and a second sleeve member adjacent to the first sleeve member and which is adapted to slidably receive a minor length adjusting vertical support member. The first sleeve member is provided with a plurality of longitudinally spaced apertures or holes in at least one surface to receive removable fastener means which releasably secure the major length adjusting support member to the desired rough linear adjustment of the length of the shore structure. The second sleeve member is provided with a minor or fine adjustment member which preferably comprises a support means movable within the second sleeve member for movably supporting the minor length adjusting vertical support member. Adjustment means are associated with the support means to provide longitudinal linear adjustment of the minor length adjusting vertical support member relative to the major length adjusting support member to thereby provide fine adjustment to the desired overall length of the major and minor length adjusting support members. In a preferred embodiment the configuration of the sleeve members is generally rectangular with an inner dimension sufficient to slidably receive standard dimension wood studs such as, for example, standard 2×4 inch studs, as the major and minor length adjusting support members. In the preferred embodiment the adjustable shore frame of the present invention is formed of metal although other materials can be used. In another embodiment the entire shore frame structure is formed of metal.

BRIEF DESCRIPTION OF THE DRAWING

For a fuller understanding of the nature and desired objects of this invention, reference should be made to the following detailed description taken in connection with the accompanying drawing, wherein like reference characters refer to corresponding parts throughout the several views of the preferred embodiments of the invention and wherein.

DETAILED DESCRIPTION OF THE PREFERRED EMBODIMENT(S)

Figure 1:
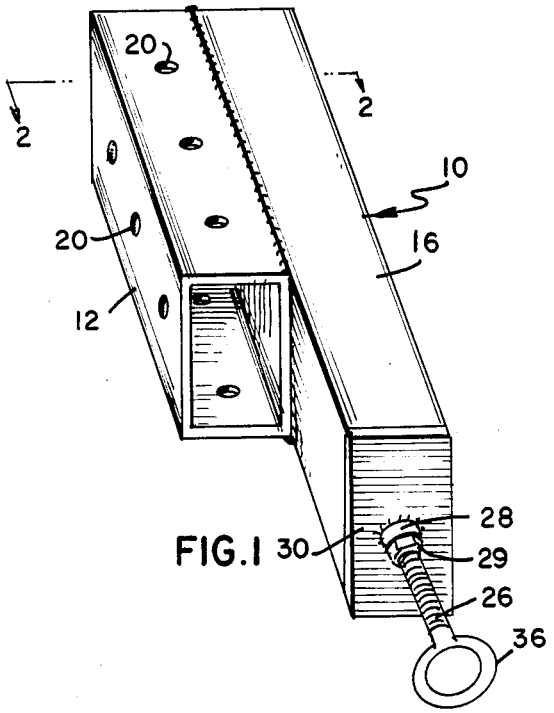
FIG. 1 is a perspective view of an adjustable shore frame in accordance with the present invention.

Referring now to the drawing, the adjustable shore frame of the present invention, shown generally at 10, comprises a first sleeve member 12 adapted to slidably receive a major length adjusting vertical support member 14 and a second sleeve member 16 adapted to slidably receive a minor length adjusting verticle support member 18. Sleeves 12 and 16 may be produced from metal, plastic or even wood to provide a shore frame having sufficient strength for the purposes for which the shore structure is to be used. For purposes of illustrating the invention, the adjustable shore frame will be described as being formed of metal although as mentioned other materials can be employed. Sleeve members 12 and 16 are preferably attached to each other by suitable attaching means, such as welding, well known to those skilled in the art.

As illustrated the configuration of the sleeve members 12 and 16 are generally rectangular and have inner dimensions whereby the sleeves can slidably receive standard dimension wood studs such as standard 2×4 inch studs.

Figure 3:
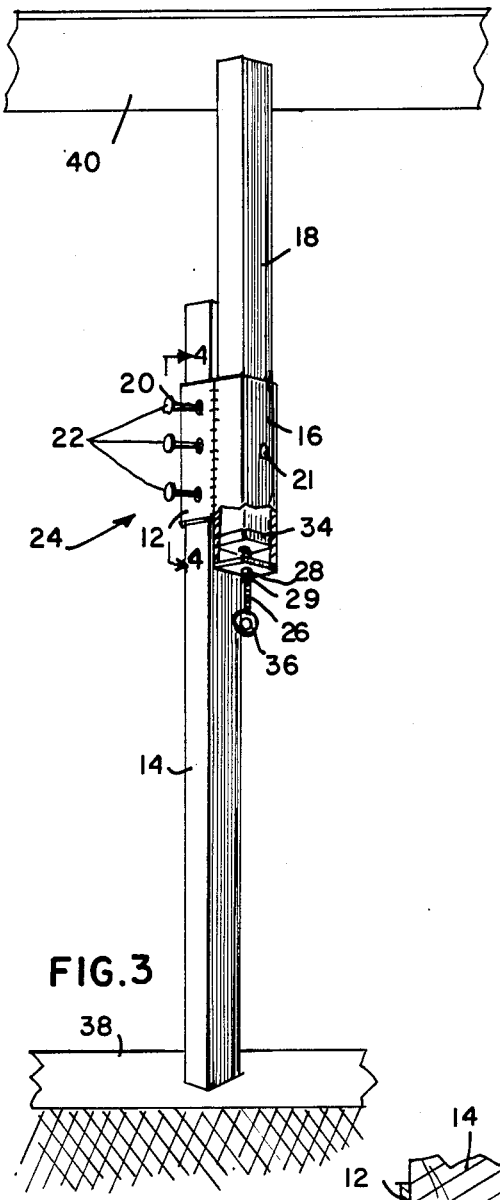
FIG. 3 is a fragmentary perspective view of an adjustable shore frame structure of the invention illustrated in supporting position.
Figure 4:
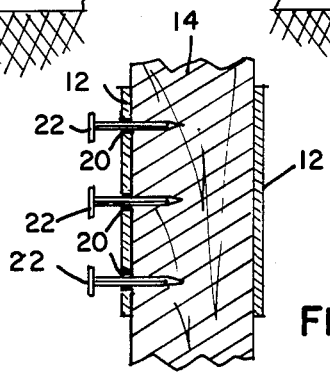
FIG. 4 is an enlarged fragmentary sectional view along the line 4—4 of FIG. 3 illustrating the releasable fastener members.

Sleeve member 12 is provided with a plurality of longitudinally spaced apertures or holes 20 adapted to receive a first adjusting means removable fastener means 22 thereby permitting the major length adjusting support member 14 to be slidably moved to various positions within sleeve 12 to obtain the major or rough adjustment of the length of the shore structure shown generally at 24 in FIG. 3. As shown in FIG. 3 the major and minor length adjusting support members 14 and 18 are formed of standard 2×4 inch wood studs. In this embodiment the fastening means 22 are standard common metal nails or metal pins or pegs which can be inserted into holes 20 of sleeve 12 and removably driven into the major length adjusting support member 14, as best seen in FIG. 4, to secure the support 14 within shore frame 10 for obtaining the major adjustment of the length of the shore structure 24.

Sleeve member 16 is also provided with a minor or fine length adjusting means also referred to herein as second adjusting means which comprises an adjustable threaded member 26 which threadably penetrates the internally threaded boss 28 attached externally to the bottom wall 30 of sleeve 16. The upper end member 32 of threaded member 26 rotatably engages and supports bearing plate 34 which is adapted to have vertical sliding movement within sleeve 16. As illustrated the upper member 32 is in the form of a disc and is disposed within chamber 33 of bearing plate 34 and freely rotatable therein. A handle or wrench receiving member 36 is provided on the lower end of threaded member 26. Additionally a locking nut 29 is provided to releasably secure the threaded member 26 in the desired position. As can now be readily appreciated rotation of member 36 in one direction clockwise, for example, raises bearing plate 34 and minor length adjusting support member 18 while rotation in the opposite direction (counterclockwise) lowers bearing plate 34 and member 18.

In a preferred embodiment an aperture or hole 21 is provided in one side of the second sleeve 16 to receive a releasable retainer means such as element 22 to secure the minor length adjusting support member 18, if desired, in the position selected to prevent member 18 from inadvertently separating or sliding from sleeve 16 when moving the adjustable shore structure 24 from one location to another.

Figure 2:
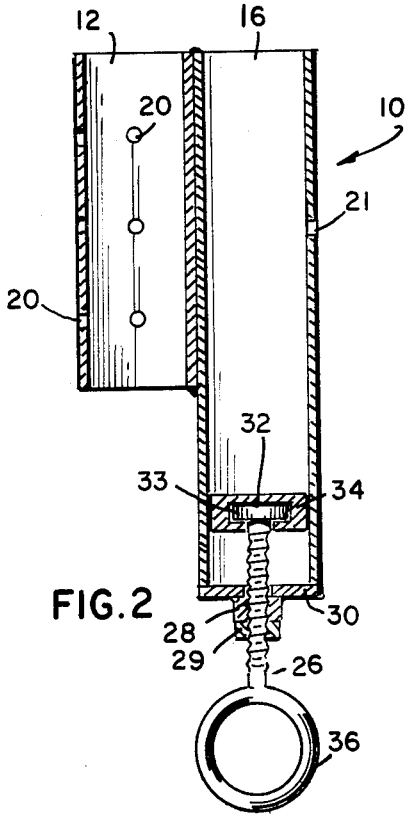
FIG. 2 is a sectional view along the line 2—2 of FIG. 1.

While in the specific embodiment of the shore frame of the present invention shown in FIGS. 1–3 the apertures or holes are disposed in all exposed sides of sleeve 12, it has been found that the longitudinal spaced disposition of holes on one side is sufficient. Disposition of holes on two or more sides has been found to be of advantage since the shore frame does not have to be positioned relative to the user to insert the fastener means 22. Additionally, while the sleeves 12 and 16 have been illustrated as having different lengths with sleeve 16 being shown as longer, it is to be understood that the lengths may be equal or unequal, the main requirement being that the sleeves be adjacent each other to provide longitudinal adjustments of the major and minor length adjusting members relative to each other. The specific embodiment illustrated provides for simple, economical fabrication of the adjustable shore frame in that both sleeves 12 and 16 can be cut and formed from the same section of material such as an elongated extruded metal sleeve fabricated by extrusion methods well known to those skilled in the art. In the preferred embodiment illustrated, sleeve 16 is preferably longer than sleeve 12 to thereby provide sufficient support of the minor length adjusting member 18 and prevent accidental separation of member 18 from sleeve 16 during longitudinal extension. In contrast major length adjusting member 14 is releasably secured within sleeve 12 by fastener means 22. Sleeve 12 can be made shorter than sleeve 16 since movement of support member 14 within the sleeve 12 is not required once the major length adjustment is made. Additionally shorter lengths of sleeve 12 provide for more economical construction while providing a lighter over all weight of the shore frame which facilitates handling by the user.

In one mode of operation, reference still being made to FIGS. 1–3, the minor length adjusting support member 18, which is shown as a length of 2×4 inch wood stud, is inserted into sleeve 16 and adjacent bearing plate 34 which is preferably retracted to the lowest position adjacent bottom wall 30. Thereafter the major length adjusting member 14, which is shown as a 2×4 inch wood stud, is inserted into sleeve 12 and the bottom or lower end positioned on the floor or base 38. The major length adjustment is now made by adjusting sleeve 12 at a position on major length adjusting member 14 so that the top end of minor length adjusting member 18 is adjacent to or just contacts member 40 which represents the object to be supported. One or more fastener means 22 are then driven into apertures 20 to secure the major length adjusting member 14 at the desired position within sleeve 12 to obtain the major or rough length adjustment. The minor or fine length adjustment is made by turning handle means 36 to raise bearing plate 34 and minor length adjusting member 18 the desired distance to thereby adjust the overall length of the adjustable shore 24 to the desired supporting position against member 40. As can be appreciated, the shore frame provides for continuous and instantaneous fine adjustment of the overall length of the shore structure. To take down the adjustable shore structure the handle means 36 is turned to retract the bearing plate 34 sufficiently to retract member 18 from contact with member 40 whereby the entire adjustable shore structure 24 can be quickly removed to another location or disassembled. When the adjustable shore structure is to be moved to a different location, where substantially the same overall length is to be employed, a fastener 22 can be temporarily inserted in opening 21 to prevent accidental separation of member 18 from sleeve 16 and thereby facilitate transportation to the new location without disturbing the major or rough length adjustment. While in the preferred embodiment of the invention, as illustrated in FIG. 3, the length of minor length adjusting member 18 is preferably shorter than the length of major length adjusting member 14, to reduce, for example, the weight on bearing plate 34 and facilitate the fine adjustment, it is to be understood that different lengths of the major and minor length adjusting members 14 and 18 may be used where one is shorter or longer than the other or where both are of the same length.

Figure 5:
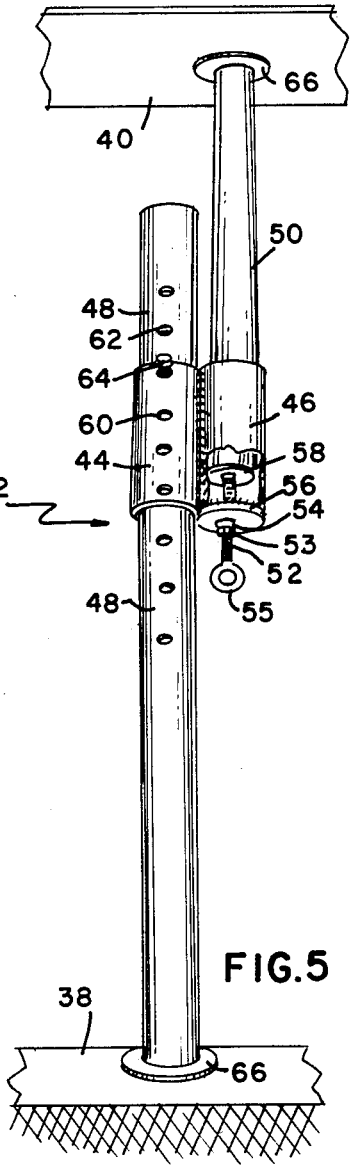
FIG. 5 is a perspective view of a modified embodiment of the adjustable shore frame structure in accordance with the invention.

Referring now to FIG. 5 there is illustrated, generally at 42, a modified form of the adjustable shore structure of the present invention. As shown the structure 42, while similar to the adjustable shore structure of FIG. 3, provides for an embodiment which is constructed of metal. The modified form includes a first sleeve member 44 and a second sleeve member 46 each of which are cylindrical in configuration and are illustrated as being of the same general length. Sleeve member 44 is adapted to slidably receive a cylindrical major length adjusting support member 48 and similarly sleeve member 46 is adapted to slidably receive cylindrical minor length adjusting member 50. Sleeve member 44 is provided with a plurality of longitudinally spaced apertures or holes 60. Corresponding holes 62 are longitudinally disposed on major length adjusting member 48. In this embodiment of the invention the major and minor length adjusting members can be provided with end or foot members 66 attached to the distal or supporting ends of the major and minor length adjusting members 48 and 50 respectively for contacting the base 38 and member 40 to be supported and serve to provide a greater contact area as well as greater distribution of weight forces. The major length adjustment is achieved by sliding member 48 within sleeve 44 to the desired rough length adjustment and inserting one or more removable retainer pins 64 into register with corresponding apertures 60 and 62. In a manner similar to the embodiment of FIGS. 1–3, sleeve member 46 is provided with a minor or fine length adjusting means which comprises an elongated adjustable threaded member 52 which threadably penetrates the internally threaded boss 54 attached externally to the bottom wall 56 of sleeve 46 and is provided with a locking nut 53. In this modified form the bearing plate 58 has a circular configuration and is adapted to have vertical sliding movement within sleeve 46. Bearing plate 58 and elongated threaded member 52 are connected in the same manner as illustrated by the corresponding parts of FIG. 2. The minor length adjustment is achieved by rotating handle 55 in the same manner as described with respect to FIGS. 1–3.

It is believed apparent from the foregoing description that the adjustable shore frame of the present invention provides an adjustable shore structure which provides improved means for quickly obtaining major and minor length adjustments to achieve the overall desired length; provides a shore which is quickly removed and readily disassembled while providing means for securing the separate parts together so that, when the adjustable shore structure is used for work of substantially uniform length requirements, it may, if desired be transported without disturbing the overall rough length adjustment; and provides an adjustable shore structure which is simple and economical in construction while being easy and certain in operation.

While the invention has been described with respect to specific embodiments thereof, it is to be understood that certain changes can be made within the spirit and scope of the invention. For example, the sleeves and major and minor length adjusting members shown and described with respect to FIGS. 3 and 5 can be mixed and matched with each other to provide an adjustable shore apparatus within the scope of the present invention. As an example sleeve 12 and major length adjusting support member 14 of FIG. 3 can be combined with sleeve 46 and minor length adjusting member 50 of FIG. 5 to provide an adjustable shore apparatus contemplated by the present invention.

Additionally it is to be understood that the shore frame can be fabricated as a unitary integral structure although economically this method of fabrication is less preferred.

While the invention has been described with respect to preferred embodiments it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in a limiting sense.

What is claimed is:

1. An adjustable shore frame comprising a first sleeve member adapted to slidably receive a major length adjusting vertical support member;

a second sleeve member adjacent said first sleeve member;

said second sleeve member having an upper end open to slidably receive a minor length adjusting vertical support member and a base means disposed across the lower end of said second sleeve member to thereby prevent passage of the minor length adjusting vertical support member beyond said base means;

support means disposed within said second sleeve member adjacent said base means and movable within said second sleeve member for supporting engagement with said minor length adjusting vertical support member;

adjusting means associated with said support means and extending through said base means for linear vertical movement of said minor length adjusting vertical support member within said second sleeve member relative to said major length adjusting vertical support member to thereby adjust the overall length of said major and said minor length adjusting support member.

2. The adjustable shore frame of claim 1 comprising a second adjusting means associated with said first sleeve member including pins adapted, in association with holes disposed in said first sleeve member, to releasably engage said major length adjusting support member and secure said first sleeve member at a selected position along said major length adjusting support member to provide the major adjustment of the overall length of said major and minor length adjusting support members.

3. The adjustable shore frame of claim 1 wherein said adjusting means associated with said support means comprises screw means threadably penetrating said second sleeve member and engaging said support means for adjusting the position of said minor length adjusting member within said second sleeve and longitudinally relative to said major length adjusting member to provide the minor adjustment of the overall length of said major and minor length adjusting support members.

4. The adjustable shore frame of claim 3 further comprising means associated with said screw means for temporarily locking said support means in position within said second sleeve member to thereby temporarily secure the selected overall length of said major and minor length adjusting support members.

5. An adjustable shore apparatus comprising:

a first sleeve member adapted to slidably receive a major length adjusting vertical support member;

a plurality of holes disposed in said first sleeve member in spaced vertical relationship;

a major length adjusting vertical support member adapted to slidably move through said first sleeve member;

a first adjusting means adapted, in association with said holes, to releasably engage said major length adjusting support member and secure said first sleeve member at a selected position along said major length adjusting support member to provide the major adjustment of the overall length of said shore apparatus;

a second sleeve member adjacent said first sleeve member;

said second sleeve member having an upper end open to slidably receive a minor length adjusting vertical support member and a base means disposed across the lower end of said second sleeve member to thereby prevent passage of the minor length adjusting vertical support member beyond said base means;

support means disposed within said second sleeve member adjacent said base means and movable within said second sleeve member for supporting engagement with said minor length adjusting vertical support member;

a second adjusting means associated with said support means and extending through said base means for linear vertical movement of said minor length adjusting vertical support member within said second sleeve member relative to said major length adjusting vertical support member to thereby adjust the overall length of said major and said minor length adjusting support member.

6. The adjustable shore apparatus of claim 5 wherein said first adjusting means comprises pins adapted, in association with said holes disposed in said first sleeve member, to releasably engage said major length adjusting support member and secure said first sleeve member at a selected position along said major length adjusting support member to provide the major adjustment of the overall length of said adjustable shore apparatus.

7. The adjustable shore apparatus of claim 5 wherein said second adjusting means comprises screw means threadably penetrating said second sleeve member and engaging said support means for adjusting the position of said minor length adjusting member within said second sleeve and is disposed longitudinally relative to said major length adjusting member to provide the minor adjustment of the overall length of said adjustable shore apparatus.

8. The adjustable shore frame of claim 7 further comprising means associated with said screw means for temporarily locking said support means in position within said second sleeve member to thereby temporarily secure the selected overall length of said adjustable shore apparatus.

9. The adjustable shore apparatus of claim 5 wherein said major length adjusting support member has a plurality of holes disposed therein in spaced vertical relationship and corresponding to said holes in said first sleeve member whereby said first adjusting means releasably engages selected holes in said first sleeve member and said major length adjusting support member to thereby provide major adjustment of the overall length of said adjustable shore apparatus.

10. The adjustable shore apparatus of claim 5 further comprising end members attached to the distal ends of said major and minor length adjusting support members.

11. The shore apparatus of claim 5 wherein said first sleeve member has a generally rectangular configuration.

12. The shore apparatus of claim 5 wherein said first sleeve member has a generally cylindrical configuration.

13. The shore apparatus of claim 5 wherein said second sleeve member has a generally rectangular configuration.

14. The shore apparatus of claim 5 wherein said second sleeve member has a generally cylindrical configuration.

15. The adjustable shore apparatus of claim 5 further comprising means associated with said second sleeve member for temporarily securing said minor length adjusting vertical support member within said sleeve.

16. An adjustable shore frame comprising a first sleeve member adapted to slidably receive a major length adjusting vertical support member;

adjusting means adapted, in association with said first sleeve member, to releasably engage said major length adjusting support member within said first sleeve member at a selected position along said major length adjusting support member to provide the major adjustment of the overall length of said major and minor length adjusting support members;

a second sleeve member adjacent said first sleeve member;

said second sleeve member having an upper end open to slidably receive a minor length adjusting vertical support member and a base means disposed across the lower end of said second sleeve member to thereby prevent passage of the minor length adjusting vertical support member beyond said base means;

support means disposed within said second sleeve member adjacent said base means and movable within said second sleeve member for supporting engagement with said minor length adjusting vertical support member;

adjusting means associated with said support means and extending through said base means comprising screw means threadably penetrating said base means of said second sleeve member and engaging said support means for linear vertical adjustment of the position of said minor length adjusting member within said second sleeve and longitudinally relative to said major length adjusting member to provide the minor adjustment of the overall length of said major and minor length adjusting support members.

* * * * *